US012208339B2

(12) United States Patent
Prieto

(10) Patent No.: US 12,208,339 B2
(45) Date of Patent: Jan. 28, 2025

(54) ELASTIC LAUNCHING CAR TOYS

(71) Applicant: Alex Prieto, Kowloon (HK)

(72) Inventor: Alex Prieto, Kowloon (HK)

( * ) Notice: Subject to any disclaimer, the term of this patent is extended or adjusted under 35 U.S.C. 154(b) by 147 days.

(21) Appl. No.: 17/974,424

(22) Filed: Oct. 26, 2022

(65) Prior Publication Data

US 2023/0321555 A1 Oct. 12, 2023

Related U.S. Application Data

(60) Provisional application No. 63/272,323, filed on Oct. 27, 2021.

(51) Int. Cl.
*A63H 17/26* (2006.01)
*A63H 29/00* (2006.01)
*A63H 29/24* (2006.01)

(52) U.S. Cl.
CPC ..... *A63H 17/262* (2013.01); *A63H 29/24* (2013.01)

(58) Field of Classification Search
CPC ..... A63H 17/00; A63H 17/008; A63H 17/26; A63H 17/262; A63H 29/18; A63H 29/24
USPC ..... 446/429, 430, 457, 459, 465, 470
See application file for complete search history.

(56) References Cited

U.S. PATENT DOCUMENTS 3,611,631 A * 10/1971 Folson ..... A63H 29/18 446/459
3,769,746 A * 11/1973 Prodger ..... A63H 29/18 446/459
3,772,822 A * 11/1973 Kupperman ..... A63H 17/18 446/459
3,798,832 A * 3/1974 Terzian ..... A63H 29/24 446/440
4,121,376 A * 10/1978 Lemelson ..... A63H 29/18 446/176
4,345,402 A * 8/1982 Hanson ..... A63H 17/008 124/31
4,413,443 A * 11/1983 Kulesza ..... A44C 9/0061 446/26
5,674,105 A * 10/1997 Hamlin ..... A63H 17/008 446/457
6,890,240 B2 * 5/2005 Chen ..... A63H 17/262 446/469
7,448,935 B2 * 11/2008 Trageser ..... A63H 29/22 446/175
7,927,173 B1 * 4/2011 Walterscheid ..... A63H 17/008 124/16
10,245,519 B1 * 4/2019 Spiegel ..... A63H 29/24
10,363,491 B2 * 7/2019 Ferreyra ..... A63H 17/002
10,646,789 B1 * 5/2020 Esposito ..... A63H 17/38
2007/0111635 A1 * 5/2007 Tooby ..... A63H 29/04 446/471
2007/0259602 A1 * 11/2007 Dunham ..... A63H 17/262 446/466

(Continued)

*Primary Examiner* — Alexander R Niconovich
(74) *Attorney, Agent, or Firm* — Hayes Soloway P.C.

(57) ABSTRACT

Toys having a rigid inner chassis and an outer body made of a very elastic and deformable material, elastomer are disclosed. The outer body of the car, when pulled back and released, enables the transfer of force directly to the wheels. The back of the chassis acts as a guide for the car. It is the point where the user's hand rests and guides its forward propulsion. Thus, the vehicle moves forward thanks to the combination of the elastic material of the outer body and the rigid chassis that holds the wheels and helps transfer the force.

12 Claims, 4 Drawing Sheets

(56) References Cited

U.S. PATENT DOCUMENTS

| | | | | |
|---|---|---|---|---|
| 2011/0263179 | A1* | 10/2011 | Martino | A63H 17/00 446/435 |
| 2015/0017870 | A1* | 1/2015 | Bird | A63H 17/264 446/124 |
| 2019/0262734 | A1* | 8/2019 | Hong | A63H 29/20 |
| 2019/0351345 | A1* | 11/2019 | Bloomfield | A63H 17/26 |
| 2023/0338864 | A1* | 10/2023 | Ma | A63H 17/262 |

* cited by examiner

ELASTIC LAUNCHING CAR TOYS

This Application claims the benefits of U.S. Provisional Application No. 63/272,323, filed on Oct. 27, 2021, and claims the benefit of its earlier date under 35 USC 119 (e).

FIELD OF THE INVENTION

This invention relates to toys vehicles. More particularly, to a toy vehicle that contains an inner rigid chassis and an outer body made of an elastic material.

The purpose of the invention is to provide a vehicle that, in spite of having an elastic outer structure, can be launched by means of an internal travel mechanism associated to its inner rigid chassis.

BACKGROUND OF THE INVENTION

The existing systems and products reveal remotely-controlled items such as cars or other vehicles that work after receiving an action on the remote control by a user. The existing systems also reveal toy cars and/or vehicles that move forward when pulled back with some strength. However, these items have a rigid structure as far as the body is concerned.

None of the existing items and products reveals an elastically deformable toy car/vehicle that moves forward when an elastic part of the body of the toy is pulled back.

SUMMARY OF THE INVENTION

This application describes an elastic toy with a rigid plastic inner chassis. The toy comprises a rigid inner chassis and an elastic outer body. The outer body is made of a very elastic material, elastomer. In one embodiment, the toy is a car. The outer body of the car is elastic and made of an elastic material, whereas the chassis is made of a rigid material that holds the wheels and the axles, if any.

The outer body of the car, when pulled back and released, allows the force to be transferred directly to the wheels. The front part of the chassis acts as a guide for the car, it is the point where the user's hand rests and guides the forward propulsion. Thus, the vehicle moves forward thanks to the combination of the elastic material of the outer body and the rigid chassis that holds the wheels and helps transfer the force.

In one embodiment, the toy makes a sound or emits a light while racing forward. In another embodiment the car may have any shape.

These and other aspects of the embodiments herein will be seen and understood better when considered together with the following description and attached drawings. However, it must be understood that even though the following descriptions relate to preferred embodiments and include numerous specific details, they are given by way of illustration but are not meant to be limiting. Many changes and modifications may be carried out within the scope of the embodiments in this document without deviating from its spirit, and the embodiments in this document include all these modifications.

BRIEF DESCRIPTION OF THE DRAWINGS

In order to complement the description that is being provided and help to better understand the characteristics of the invention, as a preferred embodiment for its practical implementation, the description includes a set of drawings that are provided by way of illustration but are not meant to be limiting, showing the following.

DETAILED DESCRIPTION

The embodiments in this document and their various characteristics and advantageous details are explained in further detail with reference to the non-limiting embodiments shown in the attached drawings and detailed in the following description. The descriptions of components and well-known processing techniques have been omitted so as not to make the embodiments in this document unnecessarily complex. Moreover, the various embodiments described herein are not necessarily mutually exclusive, since some embodiments can combine with one or more embodiments to make new embodiments. The term "or", as used in this document, refers to non-exclusive, unless otherwise stated. The examples used in this document are just intended to enable a better understanding of the ways in which the embodiments in this document can be carried out and allow experts in the technique to carry them out. Consequently, the examples must not be understood as limiting the scope of the embodiments in this document.

Figure 1:
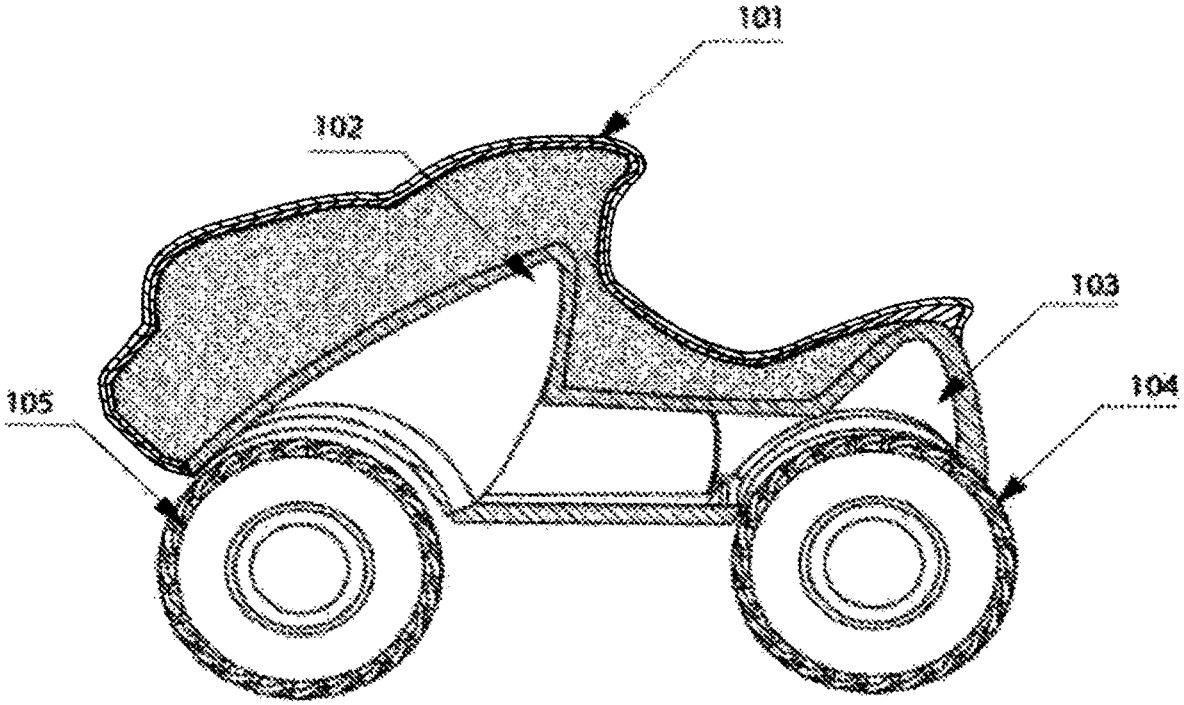
FIG. 1 shows a sectional cut of a car with an elastic outer body and a rigid inner chassis.

FIG. 1 shows a sectional view of an elastic vehicle with rigid wheels. The body of the vehicle comprises a flexible body made of a TPR-type elastomeric polymer, highly deformable, part 101, which may include an internal chamber filled with a material that may vary: liquid, sand, gel, paper, etc. The vehicle has four (4) rigid wheels. The image only shows a front wheel and a back wheel, parts 104 and 105, and they are attached to the body through a chassis that has two parts, front part 102 and back part 103, although the chassis does not need to have two parts.

Figure 2:
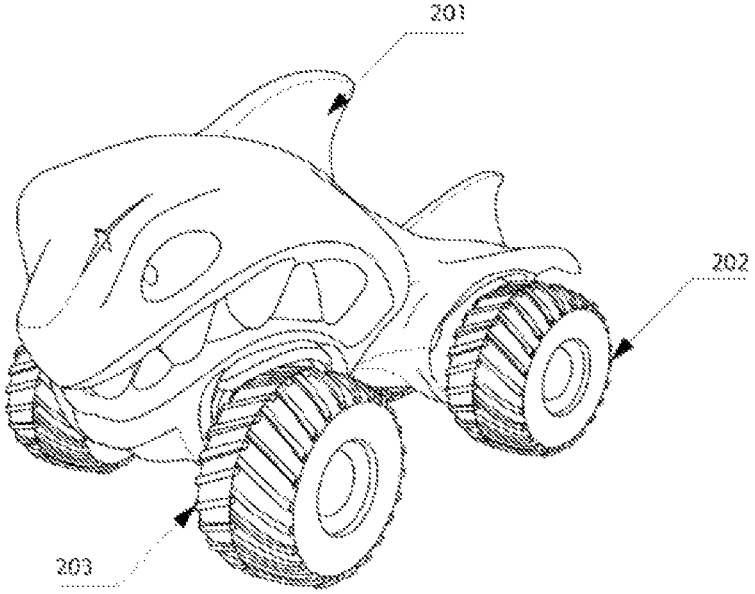
FIG. 2 shows an outer perspective view of the same vehicle.

FIG. 2 illustrates a schematic diagram showing a perspective view of an example of elastic toy vehicle 200, according to an embodiment as described in this document. In this embodiment, the elastic toy is the car 200, as seen in FIG. 2. Hereinafter, the elastic toy car 200 will be referred to as toy car 200, car 200 and/or elastic car 200.

In another embodiment, the elastic toy 200 may be any other vehicle, for example, but not limited to, a train, a bus and the like.

The car 200, as shown in FIG. 2, comprises four wheels 202, 203, 204 and 205 (the latter two are not shown or indicated in the drawing). Each wheel is guided by its respective wheel axle, if any.

Numeral 201 illustrates the deformable elastic outer body of the car 200. The outer body 201 is made of thermoplastic rubber (TPR). TPR has characteristics of both plastic and rubber and is a kind of synthetic rubber. In another embodiment, the outer body 201 may be made of any other elastic material. The outer body 201 is layered on an inner body that cannot be seen in the image of the car 200. The inner body is a chassis of the car 200. The chassis is made of a rigid material. The chassis of the car 200 comprises two parts: a front part and a back part. The two parts are attached together to form the chassis. The chassis is assembled in such a way that the outer body 201 and the chassis do not disassemble when the outer body 201 is pulled and released to a maximum length.

The outer body 201 together with the inner body make up a system that guides a movement forward of the car 200 in response to a backward movement by a user.

As seen in FIG. 2, the user of the item pulls and releases the outer body 201 of the car 200 made of TPR. The outer body 201 of the car 200, when pulled back and released, enables the transmission of direct force towards the wheels. The front transmission acts as a guide for the car 200 and makes the car 200 rash forward. Thus, the car 200 rushes forward thanks to the combination of this elastic material of the outer body 201 with the rigid chassis of the inner body that holds the wheels and helps transfer the force.

In one embodiment, the car 200 may have more or fewer characteristics and/or components than those described above.

The toy car 200, as seen in FIG. 2, moves forward when just the outer body 201 is pulled back. However, in the existing items, the entire toy is pulled back, not just the outer body 201. Therefore, the operation of the existing items and the proposed toy is different.

In one embodiment, the outer body 201 and the inner body are aligned in such as way that the entire toy car 200 experiences a movement forward due to the outer body 201 being pulled and released. The elastic material of the outer body 201 produces tension when pulled back and even more when the outer body 201 is released, and this tension turns into a movement forward of the toy car 200.

Figure 3:
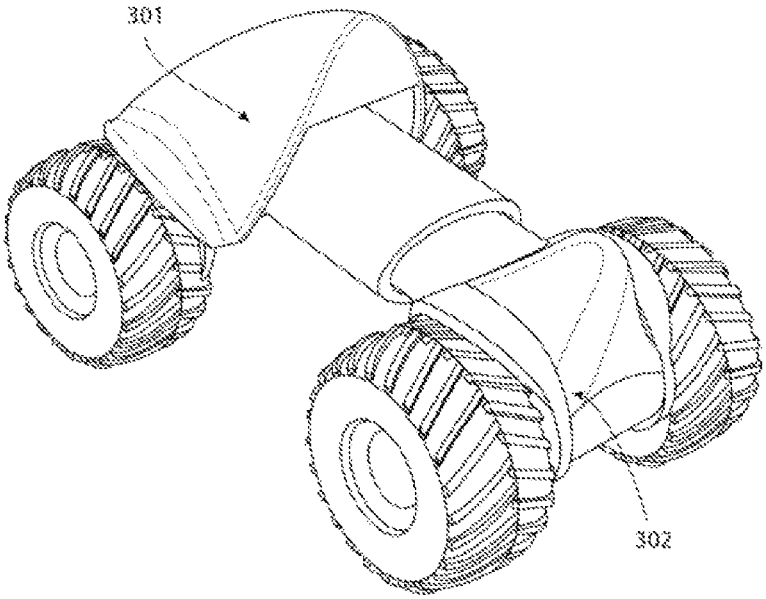
FIG. 3 shows a perspective view of the rigid inner chassis where the various parts can be seen without the outer body.

FIG. 3 shows a view of the rigid inner chassis of the vehicle. In the figure, this chassis comprises a front part 301 and a back part 302, but it could be made up of more than two parts. The rigid wheels would be attached to this chassis.

Figure 4:
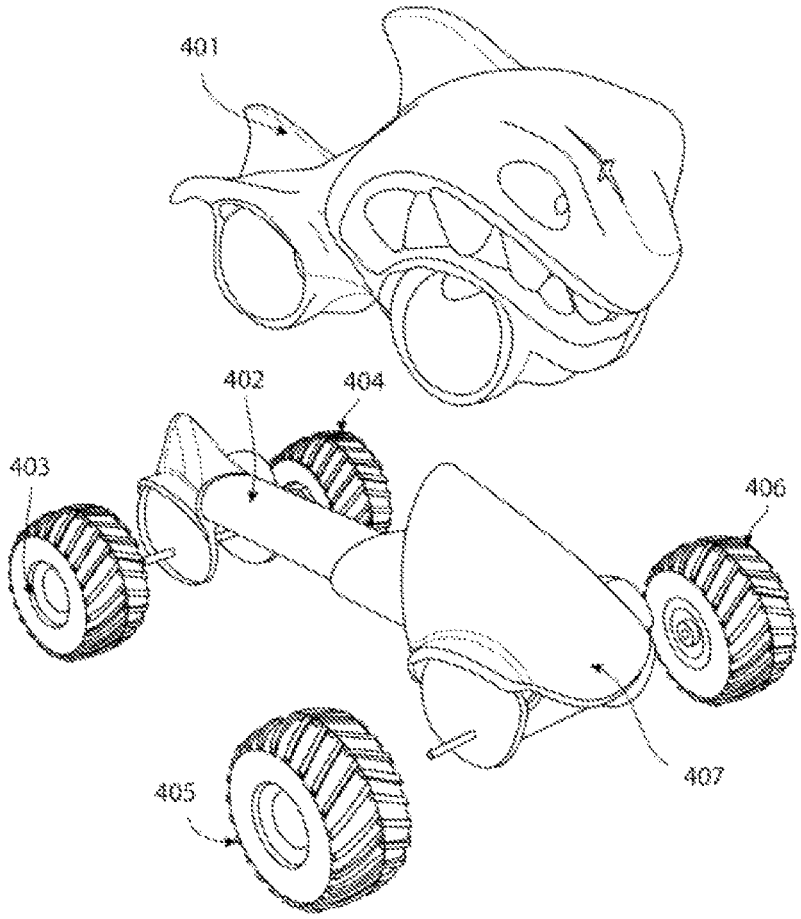
FIG. 4 shows an exploded view of the vehicle where all the parts can be seen.

FIG. 4 shows an exploded view of a sample toy car 400 shaped as a shark, according to an embodiment as described in this document. As shown in FIG. 4, the toy car 400 comprises four wheels 403, 404, 405 and 406 together with the corresponding axle. Moreover, the outer body 401 of the toy vehicle 400 is made of elastic material. The outer body 401 of the toy car 400 may be made of TPR, without it being limited to this material.

The chassis of the toy car that makes up the inner body comprises a front part 407 and a back part 402. The front part 407 and the back part 402 make up the chassis when combined. The front part 407 and the back part 402 are made of rigid material. Then, wheels 403-406 are fitted in the chassis.

The outer body 401 is placed on the combined chassis. The chassis and the outer body 401 are assembled in such a way that, when the outer body 401 is pulled back to its maximum extension, the front part 407 and the back part 402 of the chassis do not disassemble. In one embodiment, the outer body 401 of the toy car 400 is pulled back and released. The user may pull from a back end of the toy car 400, the back end being made of TPR. It must be pointed out that the user pulls back and releases only the back end and not the entire toy car 400. Pulling the back end back causes a tension in the elastic material (TPR) that makes the toy car 400 move forward. In this regard, the travel mechanism of the vehicle by pulling the rigid chassis back will be of the conventional type used in the totally rigid toys existing in the market.

The released tension enables a direct transfer of force to the wheels. The forward transfer of force acts as a guide for the toy car 400 and makes the toy car 400 race forward. Thus, the toy car 400 races forward due to the combination of this elastic material of the outer body 401 with the rigid chassis of the inner body that holds the wheels.

The above description of the specific embodiments will reveal the general nature of the embodiments in this document so fully that others, by applying current know-how, can easily modify and/or adapt it for various applications, such as specific embodiments, without these specific embodiments deviating from the generic concept. Therefore, said adaptations and modifications should aim and aim at being understood within the meaning and range of embodiments that are equivalent to those described. It must be understood that the wording or the terms used in this document are for descriptive rather than limiting purposes. Therefore, even though the embodiments in this document have been described as preferred embodiments, the experts in the technique will admit that the embodiments herein can be carried out with modifications within the scope of the embodiments described in this document.

What is claimed is:

1. A toy vehicle, which comprises;

a rigid chassis holding at least two pair of rigid wheels guided on the chassis through an axle for each pair of rigid wheels;

a body;

wherein the at least two pair of rigid wheels are attached to the body through the rigid chassis, wherein the body produces tension when pulled back, and when the body is released, this tension turns into a movement forward of the toy vehicle, and wherein the body is an outer body made of deformable elastomeric material being placed on the rigid chassis being an inner body.

2. The toy vehicle, according to claim 1, wherein the body is made of TPR elastomeric polymer.

3. The toy vehicle, according to claim 2, wherein the body is made of TPR elastomeric polymer filled with a liquid material.

4. The toy vehicle, according to claim 3, wherein the body is made of TPR elastomeric polymer with an internal chamber filled with sand.

5. The toy vehicle, according to claim 3, wherein the body is made of TPR elastomeric polymer with an internal chamber filled with gel.

6. The toy vehicle, according to claim 3, wherein the body is made of TPR elastomeric polymer with an internal chamber filled with paper.

7. The toy vehicle, according to claim 1, wherein the rigid chassis is made up of two parts, a front part and a back part, wherein each axle of the pair of rigid wheels is placed on the front part and the back part respectively.

8. The toy vehicle, according to claim 1, wherein the vehicle is a car.

9. The toy vehicle, according to claim 1, wherein the vehicle is a train.

10. The toy vehicle, according to claim 1, wherein the vehicle is a bus.

11. The toy vehicle, according to claim 1, wherein the body is made of deformable elastomeric material having a multi-layered structure placed on the rigid chassis.

12. The toy vehicle, according to claim 1, wherein the body is layered on the rigid chassis.

* * * * *